US011203103B2

(12) United States Patent
Sansone et al.

(10) Patent No.: US 11,203,103 B2
(45) Date of Patent: Dec. 21, 2021

(54) ROTOR BIT REMOVAL DEVICE

(71) Applicant: Caterpillar Paving Products Inc., Brooklyn Park, MN (US)

(72) Inventors: Dario Sansone, Castello d'Argile (IT); Mario Persano, Poggio Renatico (IT); Danilo Ciardullo, Dipignano (IT); Kevin J. Magee, Buffalo, MN (US); Prasad S. Virgi, Perungudi (IN); Marco Cesari, Budrio (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 518 days.

(21) Appl. No.: 15/995,420

(22) Filed: Jun. 1, 2018

(65) Prior Publication Data

US 2019/0366521 A1 Dec. 5, 2019

(51) Int. Cl.

| | |
|---|---|
| ***B25B 27/02*** | (2006.01) |
| ***E21C 35/18*** | (2006.01) |
| ***E01C 23/088*** | (2006.01) |

(52) U.S. Cl.

CPC ..... *B25B 27/023* (2013.01); *B25B 27/026* (2013.01); *E21C 35/188* (2020.05); *E01C 23/088* (2013.01)

(58) Field of Classification Search

CPC ..... B23P 19/02; B23P 19/025; B23P 19/027; B23P 19/04; B25B 27/02; B25B 27/026; B25B 27/023; B25B 27/0028; B25B 27/08; B25B 28/00; B25B 33/00; B25C 11/00; B25C 11/02; B28D 1/188; E21C 35/188; E01C 23/088

See application file for complete search history.

(56) References Cited

U.S. PATENT DOCUMENTS

| | | | | |
|---|---|---|---|---|
| 4,970,779 | A * | 11/1990 | Chen | B25B 9/00 29/758 |
| 6,526,641 | B1 * | 3/2003 | Latham | B25B 27/026 29/239 |
| 6,585,326 | B2 | 7/2003 | Sollami | |
| 7,097,258 | B2 | 8/2006 | Sollami | |
| 7,914,243 | B2 | 3/2011 | VanderPol et al. | |
| 8,181,322 | B2 * | 5/2012 | Lehnert | B25B 27/023 29/243 |
| 8,286,316 | B2 | 10/2012 | Lehnert et al. | |
| 9,157,320 | B2 | 10/2015 | Lehnert et al. | |
| 9,765,619 | B2 | 9/2017 | Hahn et al. | |
| 10,486,293 | B2 * | 11/2019 | Verkley | B25B 27/023 |
| 2010/0095499 | A1 * | 4/2010 | Hung | B25B 27/064 29/252 |
| 2015/0035344 | A1 | 2/2015 | Hall et al. | |
| 2017/0356472 | A1 * | 12/2017 | Ballard | H01R 43/048 |

FOREIGN PATENT DOCUMENTS

| | | |
|---|---|---|
| CN | 202357115 U | 6/2012 |
| CN | 107201714 A | 9/2017 |

* cited by examiner

*Primary Examiner* — Tyrone V Hall, Jr.
*Assistant Examiner* — Abbie E Quann
(74) *Attorney, Agent, or Firm* — Schwegman, Lundberg & Woessner

(57) ABSTRACT

A bit removal device may include a support, an extractor coupled to the support, and an actuator. The support is configured to engage a bit holder from a front side of the bit holder. The extractor is configured to engage a bit from the front side of the bit holder. The actuator is configured to move the extractor relative to the support to extract the bit from the bit holder.

20 Claims, 11 Drawing Sheets

ROTOR BIT REMOVAL DEVICE

TECHNICAL FIELD

This disclosure relates generally, but not by way of limitation, to constructing, repairing, reconditioning, or taking-up road or like surfaces. More particularly, this disclosure relates to apparatus, systems, and methods for removing bits from rotors.

BACKGROUND

Paving machines such as cold planer and rotary mixer machines include a rotor that cuts or mixes the ground or asphalt. The rotor includes bits mounted to a bit holder at the outer surface of the rotor, so that the bits engage with the ground when the rotor is pushed down by the machine. This cutting action wears rapidly on the bits, such that they require frequent replacement, in some examples as frequently as every few hours. Replacing the bits requires a technician to work in a constrained area within the rotor housing.

One attempt to address bit removal is described in U.S. Pat. No. 8,181,322 by Lehnert et al., issued on May 22, 2012. The '322 patent provides a tool for removing a chisel, in particular from a chisel holder, having a base element which receives an actuating member, wherein the actuating member has an expeller mandrel. The '322 patent requires a specific chisel holder having an opening at a back side of the chisel holder for receiving the tool, such that the tool engages and removes the chisel from the back side of the chisel holder. Various conventional attempts require a specific type of bit holder, involve approaching the bit from the back of the bit holder, create significant noise pollution, reduce visibility for the technician, etc.

SUMMARY OF THE INVENTION

To summarize at least a portion of the disclosure, a non-limiting list of examples is provided here:

In one aspect, the present disclosure relates to a bit removal device including a support, an extractor, and an actuator. The support may engage a bit holder from a front side of the bit holder. The extractor is coupled to the support and may engage a bit from the front side of the bit holder. The actuator may move the extractor relative to the support to extract the bit from the bit holder.

In another aspect, the present disclosure relates to a bit removal system including an extractor which may engage a bit from a front side of the bit holder to extract the bit from the bit holder. The bit removal system also includes a support coupled to the extractor. The support may engage the bit holder to support the extractor as it extracts the bit from the bit holder. The bit removal system also includes an actuator which may move the extractor relative to the support such that the support remains engaged with the bit holder while the extractor removes the bit from the bit holder.

In another aspect, the present disclosure relates to a method of manufacturing a bit removal device. The method includes providing a support which may engage a bit holder from a front side of the bit holder. The method further includes providing an extractor which may engage a bit from the front side of the bit holder. The method also includes coupling the support to the extractor with an actuator that moves the extractor relative to the support to extract the bit from the bit holder.

These and other examples and features of the present devices, systems, and methods will be set forth in part in the following Detailed Description. This overview is intended to provide a summary of subject matter of the present patent application. It is not intended to provide an exclusive or exhaustive removal of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

A bit removal device may include a support, an extractor, and an actuator configured such that the bit removal device approaches a bit from the front side of its bit holder and is able to extract the bit from the front side of the bit holder. Further, in some examples, the actuator may be a hydraulic actuator, a pneumatic actuator, or an electric actuator. The bit removal device may work universally rather than requiring a specific bit or bit holder. Further, the bit removal device may be quieter than, for example, a pneumatic hammer bit removal device. Finally, the bit removal device may allow for better visibility and serviceability of rotary bits.

Figure 1:
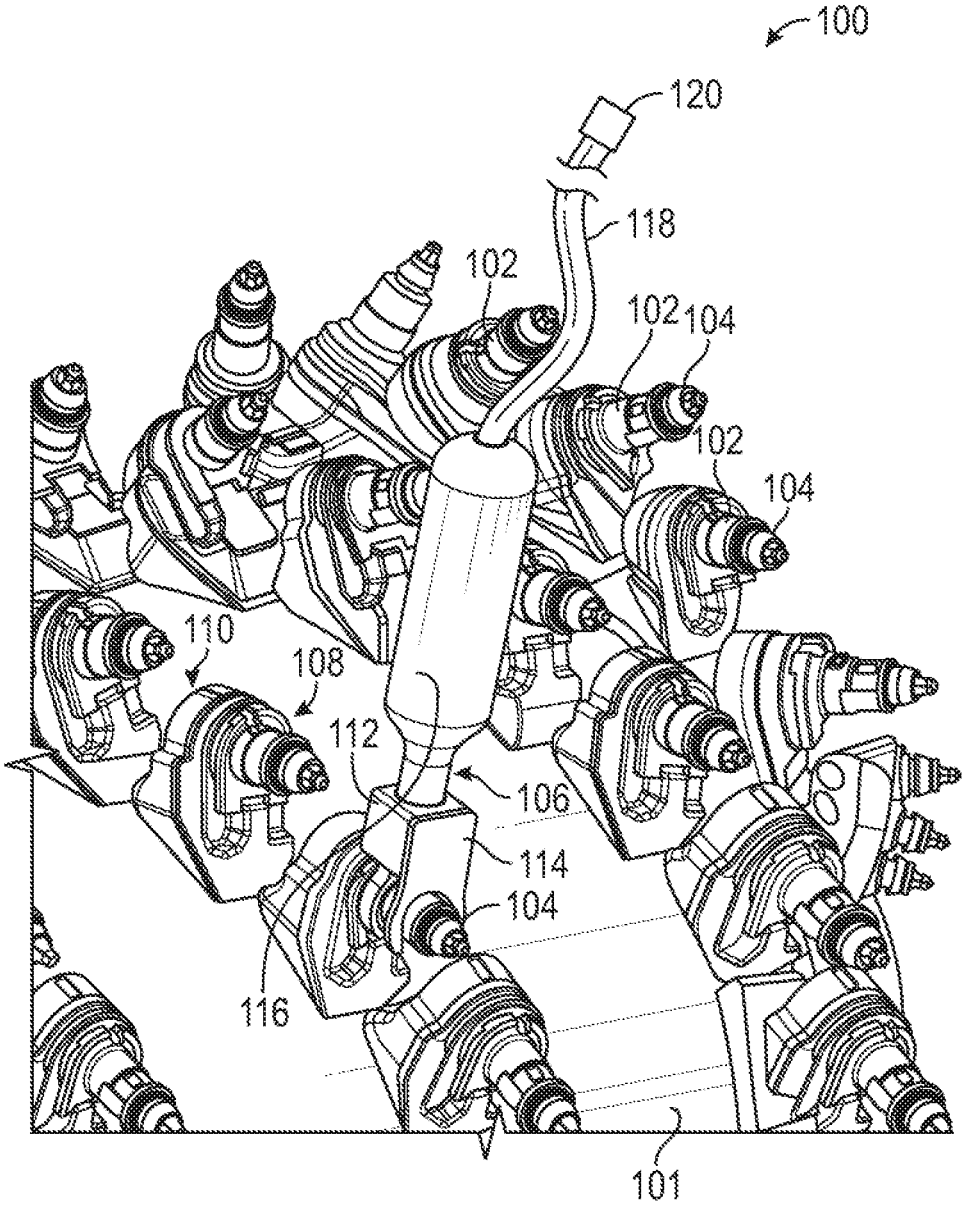
FIG. 1 is a perspective view of an exemplary bit removal device and a portion of a rotor.

FIG. 1 is a perspective view of an exemplary bit removal system 100 and a portion of a rotor 101. For example, the rotor 101 may be part of a cold planer, a rotary mixer, a paving machine, or another rotary machine. The rotor 101 includes a plurality of bit holders 102, each of which holds a bit 104. The bit removal system 100 includes a bit removal device 106, which is configured such that it can be used to approach the bit 104 from a front side 108 of the bit holder 102 and remove the bit 104 from the front side 108 of the bit holder 102 (rather than requiring a portion of the bit removal device 106 to engage or otherwise approach the back side 110 of the bit holder 102 to remove the bit 104). As such, the bit removal device 106 does not require that the bit holder 102 have any special features for the bit removal device 106 to remove the bit 104 from the bit holder 102.

The bit removal device 106 includes a support 112, an extractor 114, and an actuator 116. The extractor 114 is movably coupled to the support 112, such that the actuator 116 moves the extractor 114 relative to the support 112 to extract the bit 104 from the bit holder 102. In the illustrated example, the bit removal system 100 further includes a connector 118 connected to the bit removal device. The connector 118 may include, for example, a cord, tube, plug, socket, coupling, another connective device, a combination of these, or the like. In at least one example, the connector 118 may facilitate coupling the bit removal device 106 to a power source 120, for example a hydraulic power source, a pneumatic power source or an electric power source. In at least one example, the power source 120 is not a pneumatic hammer. In at least one example, the connector 118 may couple the bit removal device 106 to the power source 120 of the rotary machine. For example, in the case of a cold planer or a rotary mixer, the connector 118 couples the bit removal device 106 to the hydraulic system 120 of the cold planer or rotary mixer, such that the hydraulic system 120 of the cold planer or rotary mixer provides the power for the actuator 116 to move the extractor 114 relative to the support 112 to extract the bit 104. In at least one example, the actuator 116 of the bit removal device 106 includes a power source, for example a hydraulic power source, a pneumatic power source, or an electric power source. In some examples, the actuator 116 may be oriented differently than illustrated. In at least one example, the actuator 116 is oriented perpendicular to a longitudinal axis of the illustrated actuator 116. In some examples, the actuator 116 may extend from a front side of the extractor 114.

Figure 2:
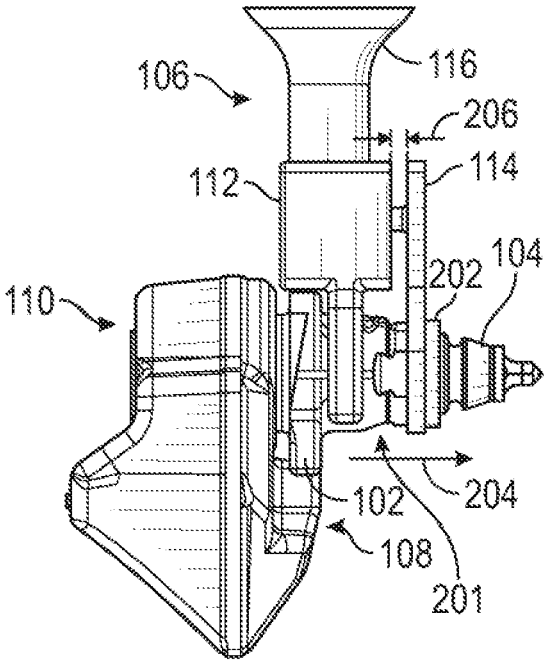
FIG. 2 is a side view of the bit removal device of FIG. 1 engaging a bit.
Figure 3:
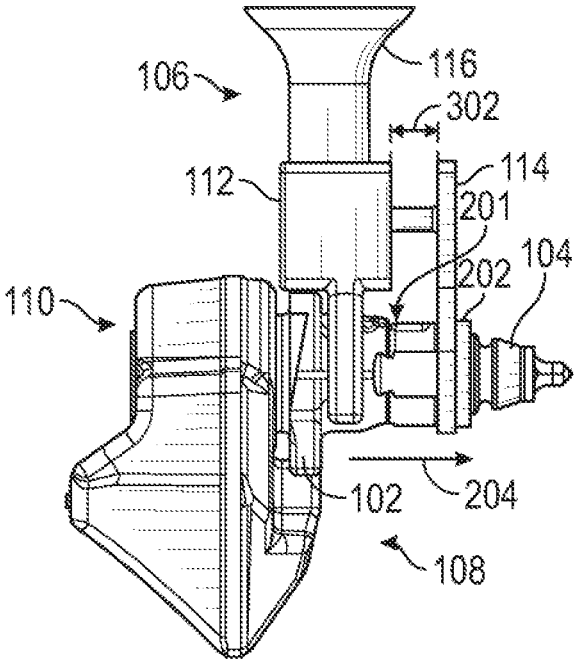
FIG. 3 is a side view of the bit removal device and bit of FIGS. 1 and 2 after the bit removal device has moved the bit.
Figure 4:
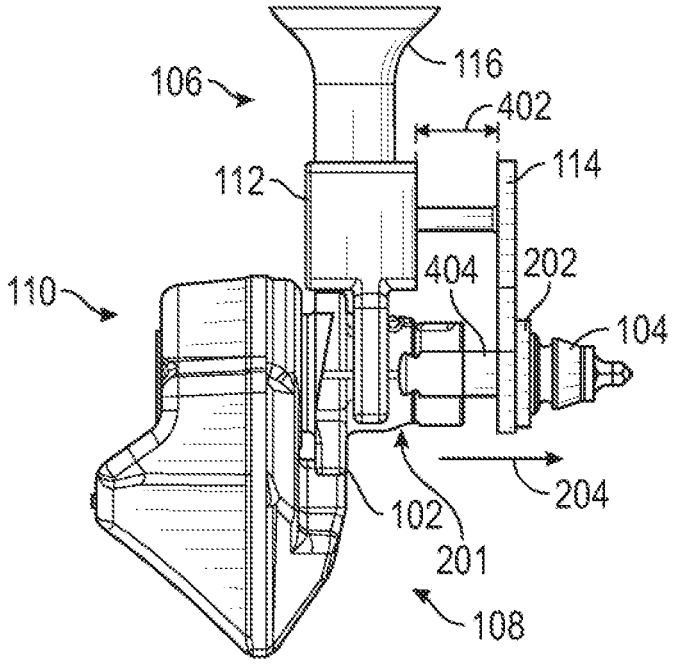
FIG. 4 is a side view of the bit removal device and bit of FIGS. 1-3 after the bit removal device has moved the bit.

FIGS. 2-4 are side views of the bit removal device 106 of FIG. 1 engaging a bit 104. As shown in FIG. 2, the bit removal device 106 has engaged the bit holder 102 and the bit 104. The support 112 extends over or around a neck portion 201 of the bit holder 102. The support 112 engages the bit holder 102 to support the extractor 114 as it extracts the bit 104 from the bit holder 102. In the illustrated example, the support 112 is an arcuate bracket that extends partially around a circumference of the neck portion 201 from a top side of the bit holder 102, however, in other examples the support 112 may have a different shape, may extend over more or less of the neck portion 201 and from a side or the bottom of the bit holder 102. In the illustrated example, the extractor 114 is an arcuate bracket that extends over the bit holder 102 behind a collar or washer 202 of the bit 104. In some examples, the extractor 114 may engage in front of the collar or washer 202, for example, in a groove such as a puller groove. In other examples, the extractor 114 may have a different shape, may extend over more or less of the bit holder 102 and from a side of the bottom of the bit older 102, as long as it still engages the collar or washer 202 of the bit 104. Once in position, the actuator 116 moves the extractor 114 in a movement direction 204, such that the support 112 remains stationary on the bit holder 102, as the extractor 114 moves relative to the support 112 to apply a force in the movement direction 204 to the back of the collar or washer 202 to move the bit 104 away from the bit holder 102. That is, the actuator 116 moves the extractor 114 relative to the support 112 such that the support 112 remains engaged with the bit holder 102 while the extractor 114 removes the bit 104 from the bit holder 102. In at least one example, the actuator 116 moves the extractor 114 axially (along a longitudinal axis of the bit 104) relative to the support 112. In at least one example, the extractor 114 moves relative to the support 112 to apply a force in the movement direction 204 to the bit via the extractor's 114 engagement with the groove (e.g. a puller groove, or a groove in front of the washer or collar 202). In at least one example, the movement direction 204 is an axial linear direction. In the illustrated example of FIG. 2, the extractor 114 is positioned a first distance 206 away from the support 112.

As illustrated in FIG. 3, the actuator 116 has moved the extractor 114 relative to the support 112 in the movement direction 204 a second distance 302, which is greater than the first distance, and the bit 104 has been moved in the movement direction 204 relative to the bit holder 102. In FIG. 4, the bit removal device 106 continues to remove or extract the bit 104 from the bit holder 102. As illustrated, the actuator 116 has moved the extractor 114 relative to the support 112 in the movement direction 204 a third distance 402, which is greater than the second distance. Due to its engagement with the collar or washer 202 of the bit 104, the extractor 114 has moved the bit 104 in the movement direction 204 relative to the bit holder 102, such that a portion of a stem 404 of the bit 104 is now visibly removed from within the bit holder 102. Once the actuator 116 has moved the extractor 114 in the movement direction 204 such that the stem 404 is fully removed from the bit holder 102, the bit 104 has been extracted from the bit holder 102, and the support 112 can disengage from the bit holder 102. In such a case, a technician might move the bit removal device 106 to a subsequent bit 102 in need of servicing to remove the subsequent bit 104 from its bit holder 102. It should be noted that the bit removal device 106 removed the bit 104 without approaching or engaging the bit 104 from a back side 110 of the bit holder 102. As such, the bit removal device 106 can remove any bit 104 from any bit holder 102, so long as the extractor 114 can engage a collar or washer 202 of the bit 104.

Figure 5:
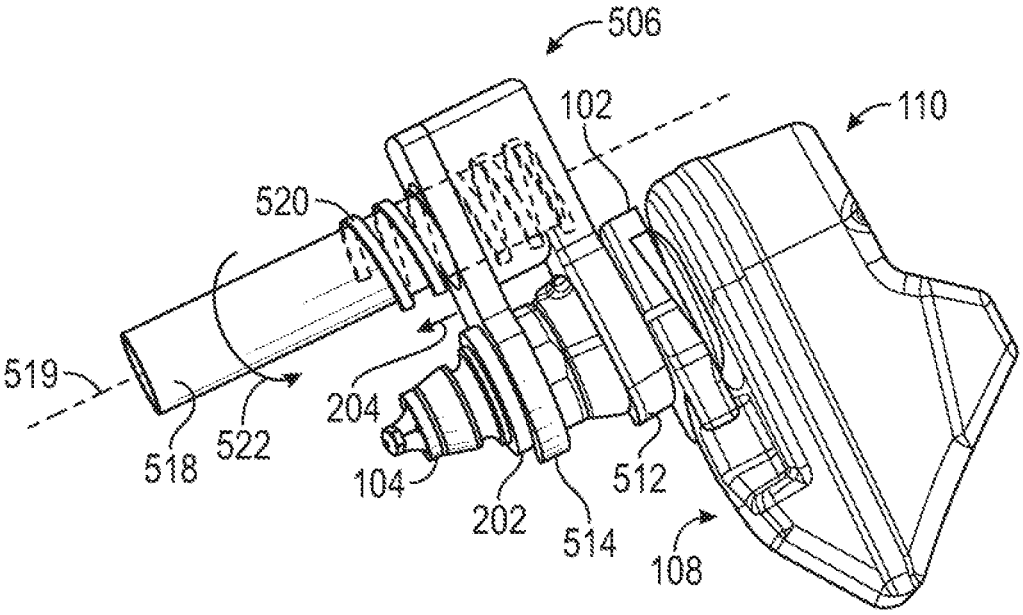
FIG. 5 is a perspective view of an exemplary bit removal device engaging a bit.

FIG. 5 is a perspective view of an exemplary bit removal device 506 engaging a bit 104. The bit removal device 506 includes a support 512 and an extractor 514, similar to the support 112 and the extractor 114 described above with reference to FIGS. 1-4. The bit removal device 506 further includes a leadscrew 518 defining a longitudinal axis 519 and including threads 520 which correspond to internal threads of the support 512. An actuator 116 (see FIGS. 1-4) rotates the leadscrew 518 in a rotational direction 522 about the longitudinal axis 519 to move the leadscrew 518 and therefore the extractor 514 in the movement direction 204 along the longitudinal axis 519 (an axial direction) to remove the bit 104 from the bit holder 102. In at least one example, the longitudinal axis 519 is parallel to a longitudinal axis of the bit 104. In some examples, the actuator 116 includes a driver to rotate the leadscrew 518. In at least one example, the actuator 116 includes an electric power source as described elsewhere in this disclosure. In some examples, the bit removal device 506 includes a connector 118 (see FIG. 1) that connects the bit removal device 506 to a power source 122 (see FIG. 1), for example an electric power source.

In some examples, the bit removal device 506 may include one or more hydraulic cylinders to provide the force to move the extractor 514 relative to the support 512. In at least one example, the bit removal device 506 does not include the leadscrew 518.

Figure 6:
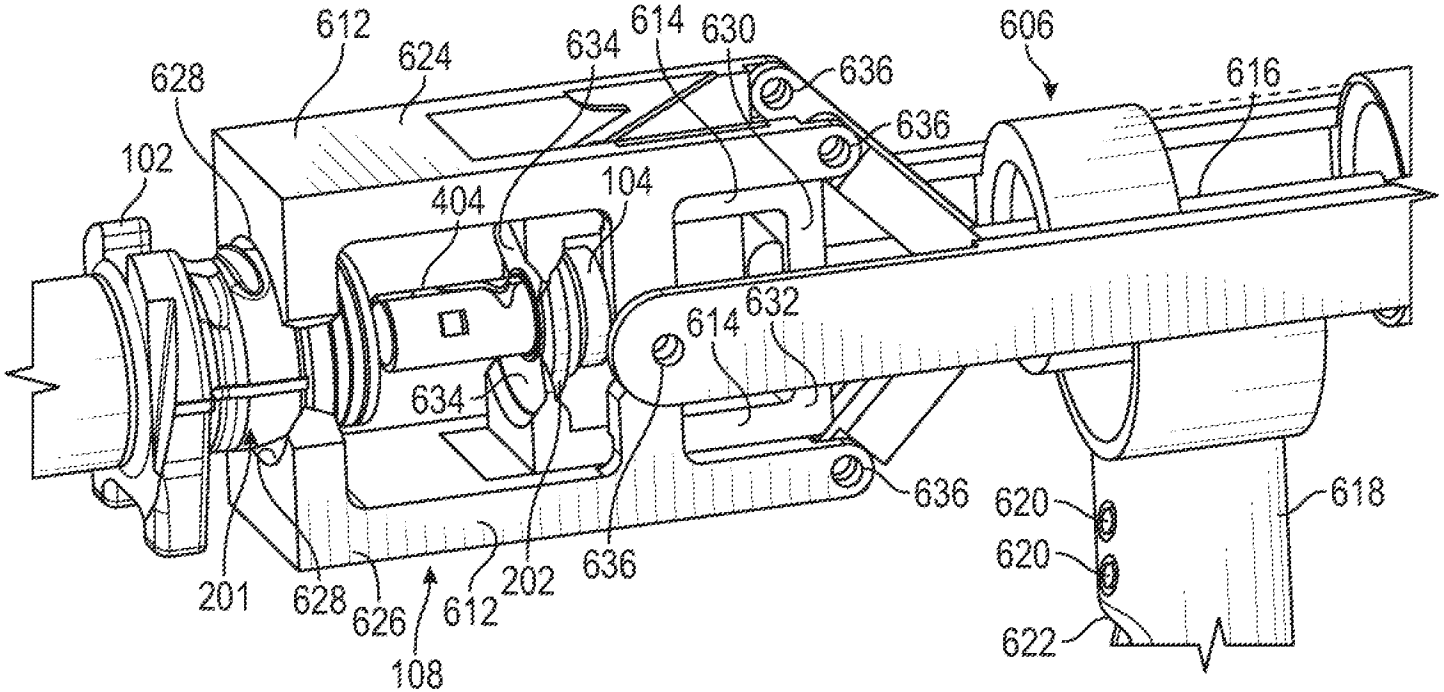
FIG. 6 is a perspective view of an exemplary bit removal device removing a bit.

FIG. 6 is a perspective view of an exemplary bit removal device 606 removing a bit 104 from a bit holder 102. The bit removal device 606 includes a support 612, and extractor 614, an actuator 616, a handle 618, and a user interface 620. In various examples, the user interface 620 may include one or more triggers or buttons. In at least one example, the user interface 620 may include a display or a touch screen. A user (e.g., a technician) may interact with the user interface 620 to control movement of one or more aspects of the bit removal device 606. For example, the actuator 616 receives a signal from the user interface 620 to control movement of the extractor 614 (e.g., to start, stop, or change direction of, movement of the extractor 614 relative to the support). In the illustrated example, at least a portion of the user interface 620 is positioned on the handle 618. In other examples, the user interface 620 may be positioned elsewhere on the bit removal device 606. In at least one example, the user interface 620 may be a separate or external device in communication with the bit removal device 606. In the illustrated example, the handle 618 includes a grip 622, however, in other examples the handle 618 may be arranged differently or include different features to accommodate various positions. In at least one example, an external surface of the actuator 616 serves as a handle 618 for the technician. While the illustrated example shows the actuator 616 as a hydraulic actuator including a hydraulic cylinder and piston, in other examples the actuator 616 may be an electric actuator, or the power source (electric or hydraulic) may be external and connected to the actuator 616 via a connector 118 as described with reference to FIG. 1.

In the illustrated example, the support 612 includes first and second support arms 624, 626 extending from opposite sides of the circumference of the neck portion 201 of the bit holder 102. Each support arm 624, 626 includes an arcuate bracket 628, such that it can fit around the circumference of the neck portion 201. In other examples, each support arm 624, 626 may include any of a variety of surfaces to engage the bit holder 102, for example, one or more fingers, a non-arcuate bracket, a surface that corresponds to the shape of a portion of the bit holder 102, a combination of these, or the like. The extractor 614 is illustrated as having first and second extractor arms 630, 632 extending on opposite sides of the bit 104. Each of the first and second extractor arms 630, 632 includes an arcuate bracket 634 to engage a portion of the bit 104 behind the collar or washer 202. In at least one example, the arcuate bracket 628 of each support arm 624, 626 has a different radius of curvature than the arcuate bracket 634 of each extractor arm 630, 632. In at least one example, the different radii of curvature correspond to the differences in circumference of the neck portion 201 of the bit holder 102 and the relevant portion of the bit 104. In the illustrated example, each of the support 612 and the extractor 614 includes one or more hinge points 636, the purpose of which is further illustrated with respect to FIGS. 7 and 8.

Figure 7:
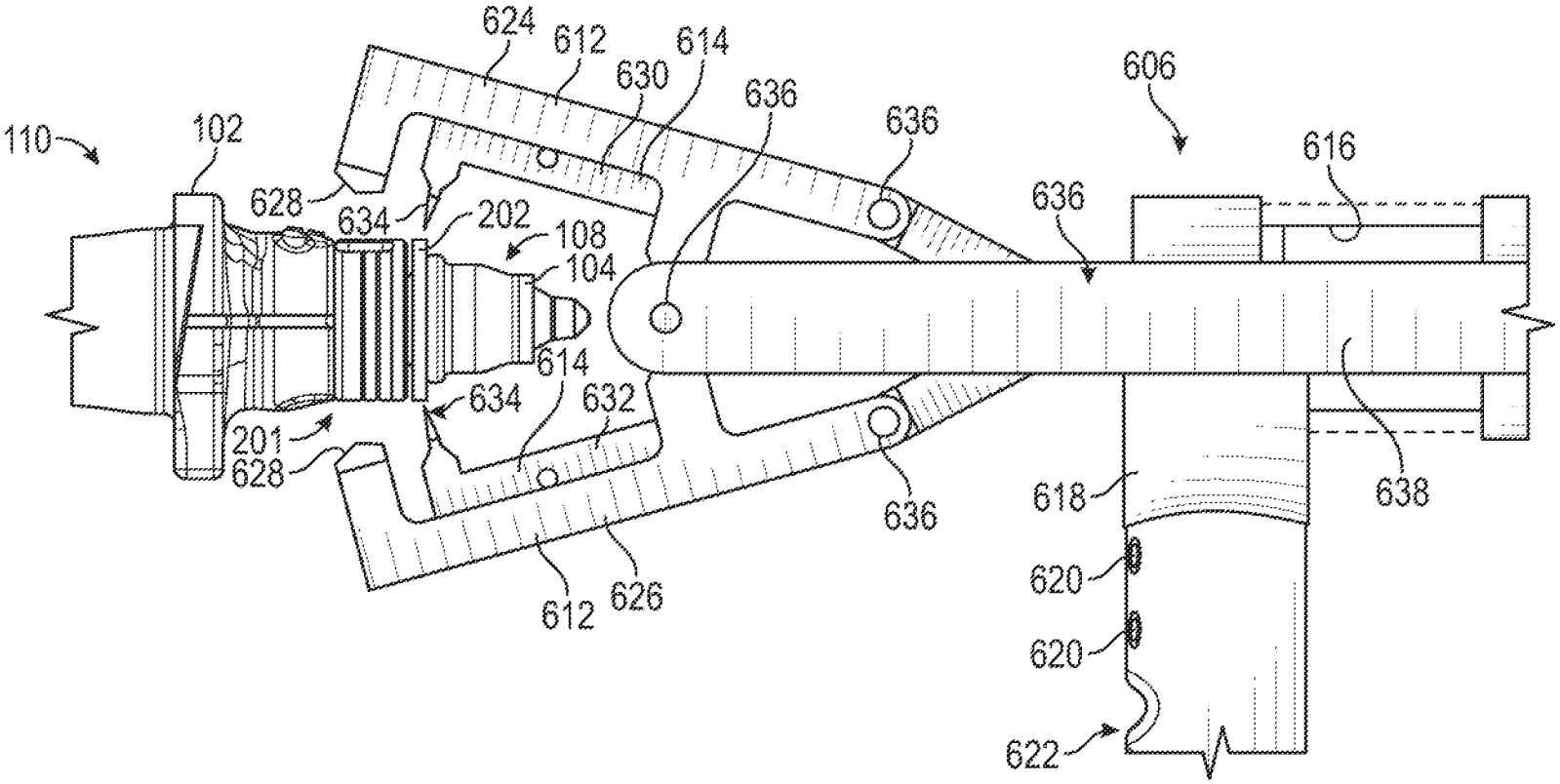
FIG. 7 is a side view of the bit removal device and bit of FIG. 6 before the bit removal device has engaged the bit.

FIG. 7 is a side view of the bit removal device 606 and bit 104 of FIG. 6 before the bit removal device 606 has engaged the bit 104. Each of the support 612 and the extractor 614 are in an open position, such that they can be positioned over the selected bit 104 before clamping down on the bit holder 102 and bit 104. In the open position, the first support arm 624 is moved away from the second support arm 626 by pivoting at one or more of its hinge points 636. Similarly, the first extractor arm 630 is moved away from the second extractor arm 632 in the open position by pivoting at one or more hinge points 636. In at least one example, there is overlap in the hinge points 636 of the support 612 and the extractor 614.

Figure 8:
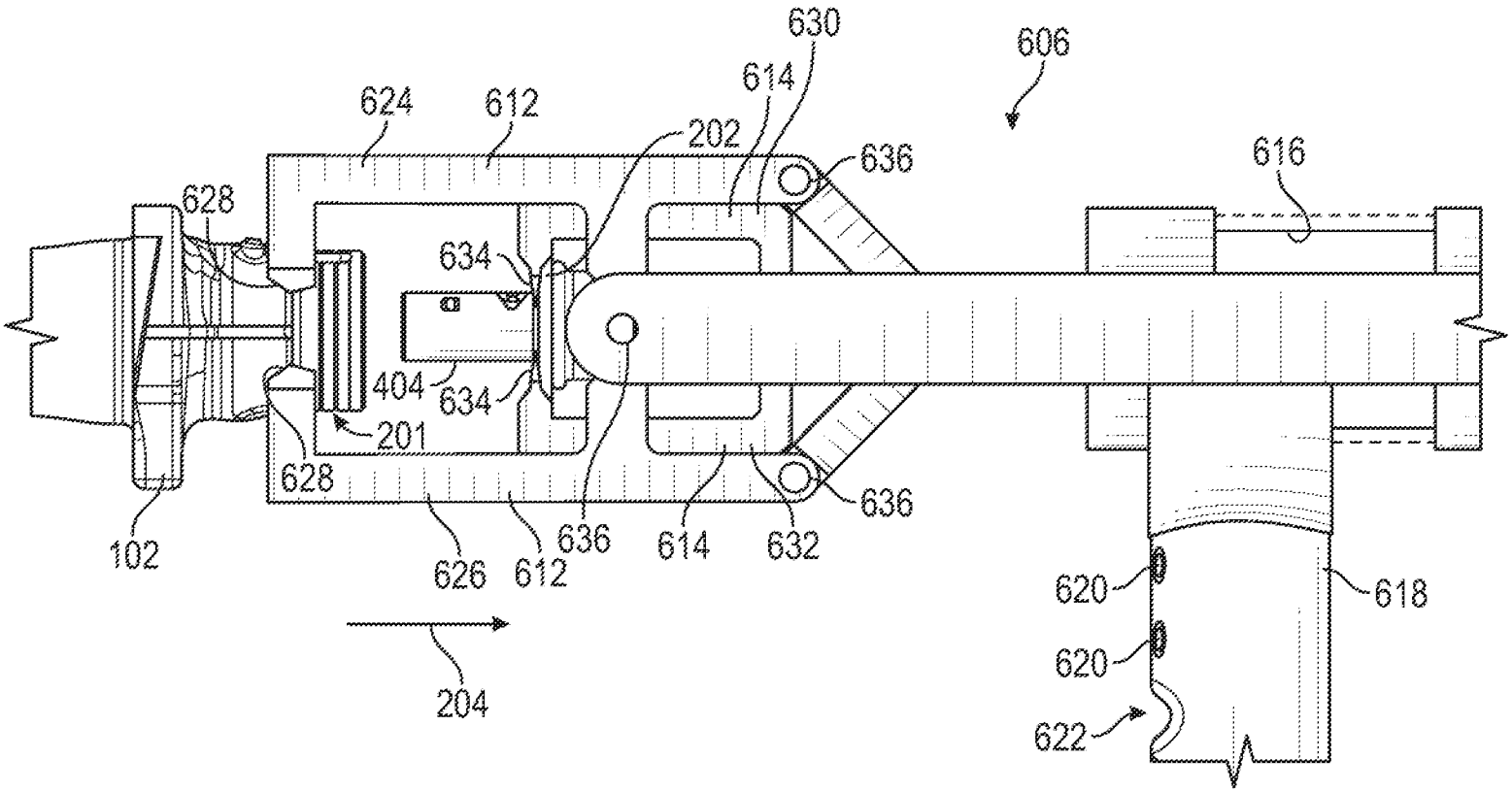
FIG. 8 is a side view of the bit removal device and bit of FIGS. 6 and 7 after the bit removal device has removed the bit.

FIG. 8 is a side view of the bit removal device 606 and bit 104 of FIGS. 6 and 7 after the bit removal device 606 has removed the bit 104. Each of the support 612 and the extractor 614 are in a closed position, and the extractor 614 has moved in the movement direction 204 relative to the support 612 applying a force to the back of the collar or washer 202 of the bit 104 to remove the bit 104 from the bit holder 102. In the closed position, one or more hinge points 636 have adjusted to allow the arcuate brackets 628 of the support 612 to engage the neck portion 201 of the bit holder 102. Further, one or more hinge points 636 have adjusted to allow the arcuate brackets 634 of the extractor 614 to engage the bit 104 behind the collar or washer 202.

In at least one example, the actuator 616 controls the opening and closing of the support 612 and the extractor 614. In some examples, the user interface 620 allows a user to send a signal to the actuator 616 to initiate opening or closing of the bit removal device 606. In at least one example, the closing action is combined with the removal action, such that when the actuator 616 receives a signal from the user interface 620 to close the bit removal device 606, the actuator 616 closes the bit removal device 606 to engage the bit holder 102 and bit 104 and subsequently moves the extractor 614 relative to the support 612 to remove the bit 104 from the bit holder 102. In some examples, opening and closing the device involves a second actuator 638. The second actuator 638 may be a mechanical, electric, or hydraulic actuator. In at least one example, the user interface 620 may initiate action by the second actuator 638. In at least one example, a button or a trigger is used to initiate the second actuator 638. In some examples, the bit removal device is biased in the closed position.

Figure 9:
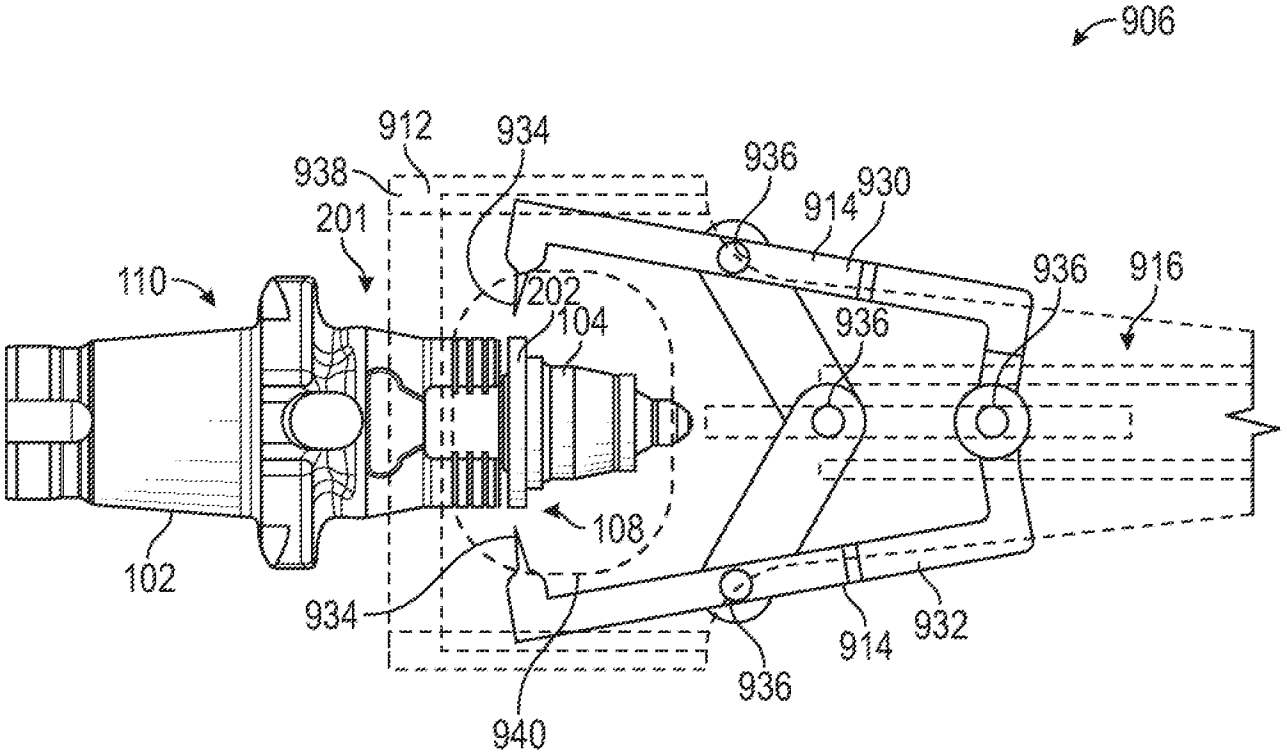
FIG. 9 is a side view of an exemplary bit removal device and a bit before the bit removal device has engaged the bit.

FIG. 9 is a side view of an exemplary bit removal device 906 and a bit 104 before the bit removal device 906 has engaged the bit 104. The bit removal device 906 includes a support 912, an extractor 914, and an actuator 916. The extractor 914 includes a first extractor arm 930 and a second extractor arm 932. In at least one example, each extractor arm 930, 932 includes an arcuate bracket 934 for engaging the bit 104 behind a collar or washer 202 of the bit 104. The extractor 914 includes one or more hinge points 936, such that the first and second extractor arms 930, 932 may separate into the open position shown in FIG. 9 to be positioned over the bit 104. While four hinge points 936 are shown in the illustrated example, other examples may include more or less hinge points 936 to control the opening and closing of the extractor 914. The support 912 includes a sleeve 938 that houses at least a portion of the extractor 916. In some examples, at least a portion of the sleeve 938 may be cylindrical or semicylindrical. In some examples, the sleeve 938 may include an arcuate bracket. The sleeve 938 engages the neck portion 201 of the bit holder 102 to support the extractor 914 as the extractor 914 removes the bit 104 from the bit holder 102. In at least one example, the sleeve 938 is configured to slide over the bit 104 from a front side 108 of the bit holder 102. In some examples, the sleeve 938 may define a window 940 that can facilitate a user's visibility when lining up and engaging the extractor 914 with the bit 104.

Figure 10:
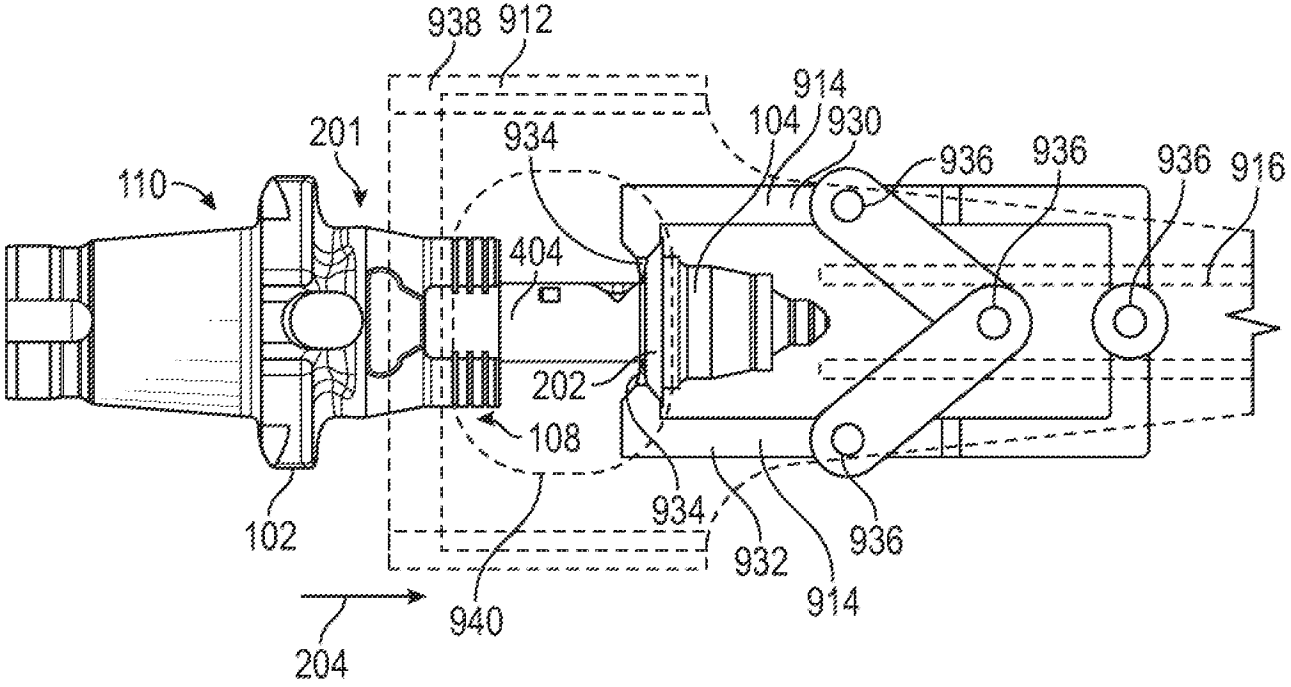
FIG. 10 is a side view of the bit removal device and bit of FIG. 9 as the bit removal device is removing the bit.

FIG. 10 is a side view of the bit removal device 906 and bit 104 of FIG. 9 as the bit removal device 906 is removing the bit 104. The extractor 914 is shown in the closed position with the arcuate bracket 934 of each extractor arm 930, 932 engaging the bit 104 behind the collar or washer 202. The support 912 has remained engaged with the bit holder 102 and supported the extractor 914 as the actuator 916 has moved the extractor 914 in the movement direction 204 to remove the bit 104 from the bit holder 102. The power source for the bit removal device 906, may be any of the power sources discussed elsewhere in this disclosure, for example, an electric or hydraulic power source which may be included with the actuator 916 or may be external to the bit removal device 906 and connected via a connector 118.

Figure 11:
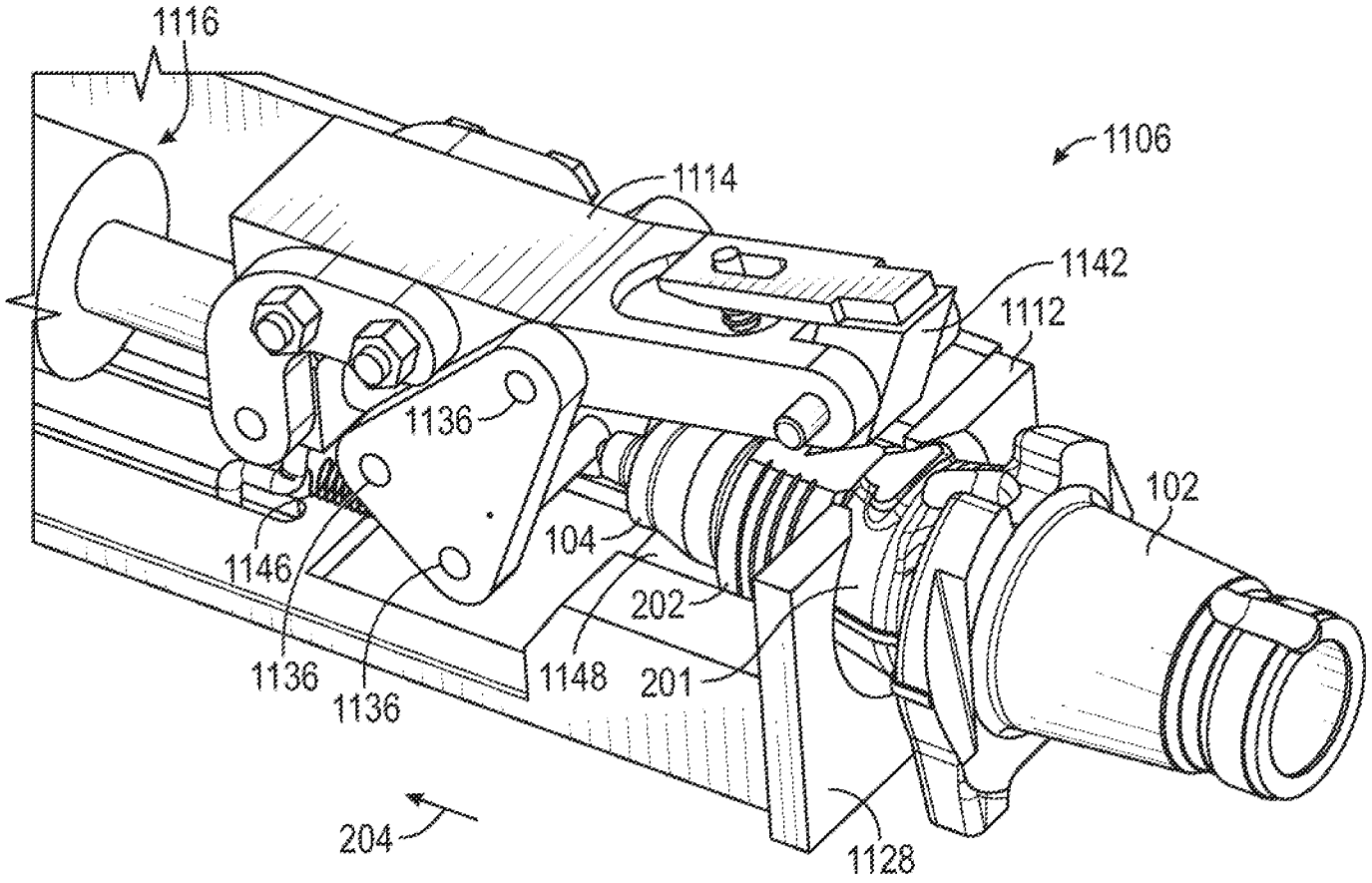
FIG. 11 is a perspective view of an exemplary bit removal device and a bit before the bit removal device has engaged the bit.

FIG. 11 is a perspective view of an exemplary bit removal device 1106 and a bit 104 before the bit removal device 1106 has engaged the bit 104. The bit removal device 1106 includes a support 1112, an extractor 1114, and an actuator 1116. The extractor 1114 includes a lever 1142 that engages the bit 104 and adjusts as the actuator 1116 moves the extractor 1114 relative to the support 1112 in the movement direction 204, such that the lever 1142 moves radially inward (relative to an axis of the bit 104) to engage the back of the collar or washer 202 further. In at least one example, the lever 1142 is a tilting lever that tilts as the extractor 1114 moves in the movement direction. In some examples, the lever 1142 includes a lever bias 1144 to bias the angle of the lever 1142 until the lever 1142 engages the collar or washer 202, and the force overcomes the lever bias 1144, adjusting the angle of the lever 1142 to allow the lever 1142 to engage the collar or washer 202 further. In at least one example, the lever bias 1142 is a spring. In some examples, the lever 1142 engages the collar or washer 202 in a first position and moves to a second position as the bit 104 is removed from the bit holder 102, with the second position being deeper or further behind the collar or washer 202 than the first position. In some examples, the extractor 1114 includes an extractor bias 1146 to bias at least a portion of the extractor 1114 toward deeper engagement with the bit 104, for example, toward the longitudinal axis of the bit 104. In some examples, the extractor 1114 further includes one or more hinge points 636 to allow the extractor 1114 to tilt and adjust to further engage the bit 104.

The support 112 may include an arcuate bracket 1128 that engages the neck portion 201 of the bit holder 102 to support the extractor 1114 and maintain the position and orientation of the bit removal device 1106 as the extractor 1114 removes the bit 104 from the bit holder 102. In some examples, the support 112 may include a seat 1148 that guides the collar or washer 202 during removal of the bit 104. In at least one example, the seat 1148 helps maintain the orientation of the bit 104 to ensure extraction in the movement direction 204 will move the bit 104 along its longitudinal axis. In some examples, the seat 1148 allows for smooth sliding of the bit 104 along the seat 1148. For example, the seat 1148 may include a coating or otherwise be made of a material that is slippery, slick, or otherwise has a low coefficient of friction. In at least one example, the support 1112 comprises hardened steel. The power source for the bit removal device 1106, may be any of the power sources discussed elsewhere in this disclosure, for example, an electric or hydraulic power source which may be included with the actuator 1116 or may be external to the bit removal device 1106 and connected via a connector 118.

Figure 12:
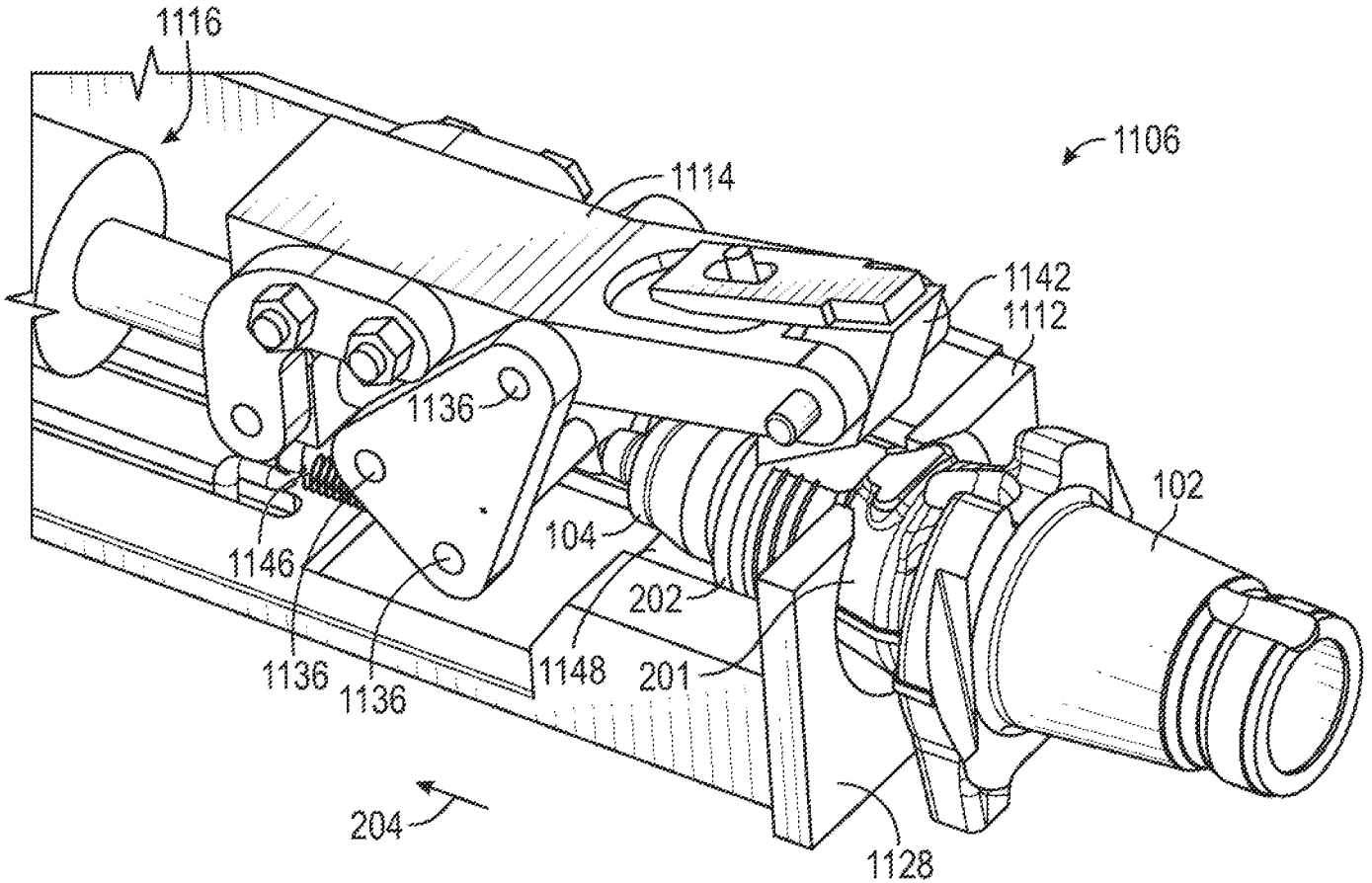
FIG. 12 is a perspective view of the bit removal device and the bit of FIG. 11 with the bit removal device engaging the bit.
Figure 13:
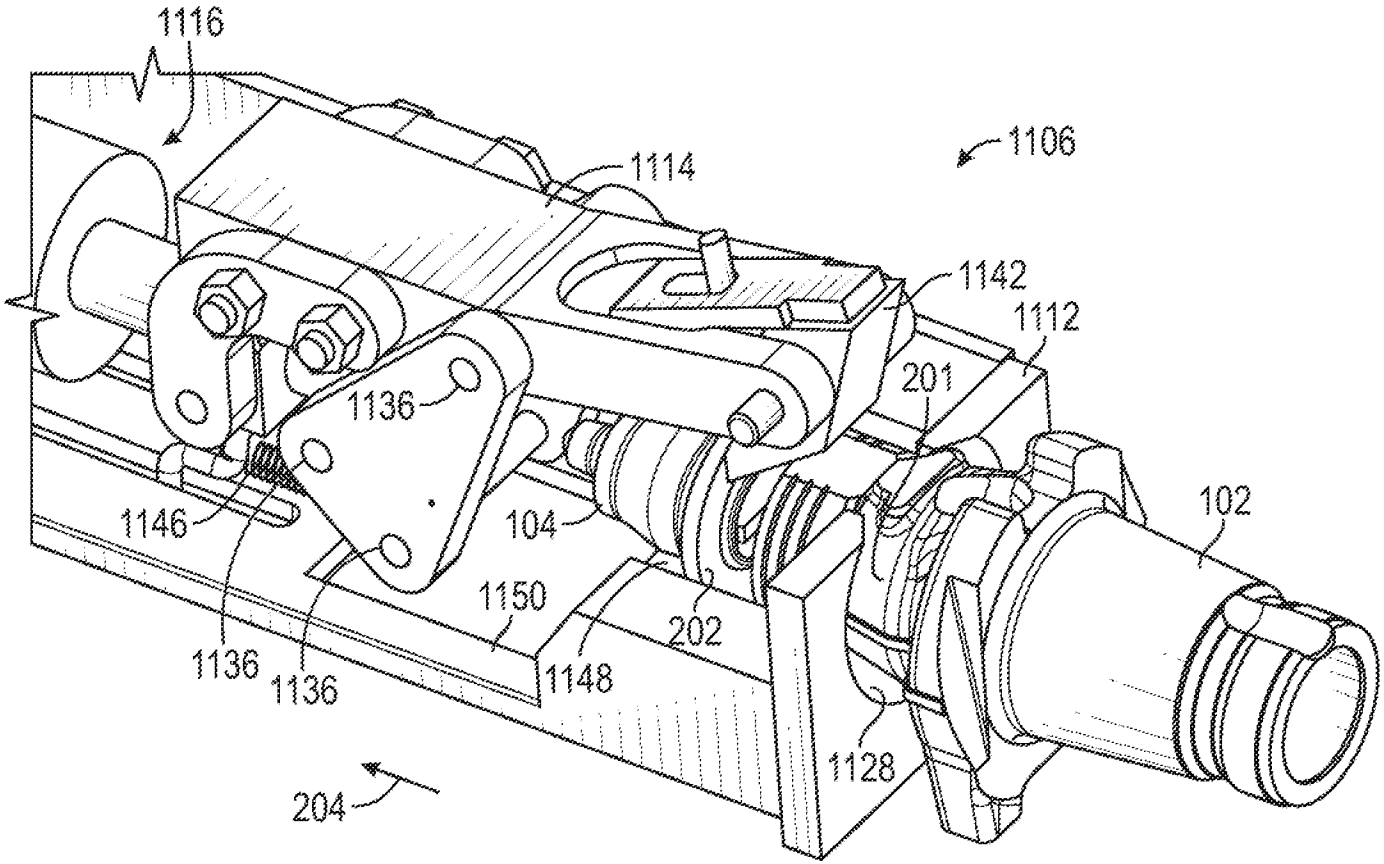
FIG. 13 is a perspective view of the bit removal device and the bit of FIGS. 11 and 12 as the bit removal device is removing the bit.

FIG. 12 is a perspective view of the bit removal device 1106 and the bit 104 of FIG. 11 with the bit removal device 1106 engaging the bit 104 in a first position. In the first position, the force of the collar or washer 202 against the lever 1142 (due to movement of the extractor 1114 in the movement direction 204) partially compresses the lever bias 1144 and tilts the lever 1142. As the actuator 1116 continues moving the extractor 1114 in the movement direction 204, the lever 1142 automatically moves into a second position, for example as shown in FIG. 13. In this second position, a greater portion of the lever 1142 is in contact with the bit 104 (specifically, the collar or washer 202) than in the first position. As the actuator 1116 continues moving the extractor 1114 in the movement direction 204, the force of the collar or washer 202 against the lever 1142 causes the lever bias 1144 to compress and the lever 1142 to engage the bit 104 deeper to facilitate a stronger hold on the bit 104 as it is removed. In at least one example, the extractor bias 1146 pulls at least a portion of the extractor 1114 downward to facilitate the deeper engagement by the lever 1142. In at least one example, the support 1112 defines an opening 1150, such that when the extractor 1114 extracts the bit 104 from the bit holder 102, the bit 104 falls freely through the opening 1150, and the bit removal device 1106 may be used on a subsequent bit 104.

All of the disclosed examples are configured to approach the bit from a front side of the bit holder without requiring any part of the bit removal device to extend to or engage a back side of the bit holder to remove the bit. It should be noted that while certain features are described with regard to certain figures, many of the features from the different figures can be combined in a single embodiment, and many of the descriptions apply to similar elements throughout the figures. In some examples, one or more portions of the bit removal device may comprise plastic or metal. In some examples, instead of the extractor engaging the bit from behind the washer or collar, the extractor may engage a groove on the bit, for example a puller groove, which may be positioned anywhere on the bit. In some examples, one or more parts of the extractor (e.g. an arcuate bracket) may be resiliently mounted or spring loaded to account for wear of the washer, collar, groove, or other portion of the bit. In some examples, one or more parts of the support (e.g. an arcuate bracket) may be resiliently mounted or spring loaded to account for wear of the bit holder.

In at least one example, the bit removal device does not require that the bit holder have any special features for the bit removal device to remove the bit from the bit holder. In at least one example the bit removal device may require the bit holder to have one or more surfaces corresponding to one or more surfaces of the bit removal device, such that the bit removal device may engage the bit holder. In at least one example, the bit holder has one or more flat surfaces corresponding to one or more flat surfaces of the bit removal device, such that the bit removal device can engage the bit holder. In at least one example, the bit removal device does not require that the bit have any special features for the bit removal device to remove the bit from the bit holder. In at least one example the bit removal device may require the bit to have one or more surfaces corresponding to one or more surfaces of the bit removal device, such that the bit removal device may engage the bit. In at least one example, the bit has one or more flat surfaces corresponding to one or more flat surfaces of the bit removal device, such that the bit removal device can engage the bit. While some examples show a particular orientation of a handle or power source, in some examples this orientation may differ (e.g., the handle shown FIG. 1 may extend perpendicular relative to the longitudinal axis of the illustrated example, or in any other direction or at any other angle as desired).

In the foregoing Detailed Description, it can be seen that various features are grouped together in a single example for the purpose of streamlining the disclosure. This method of disclosure is not to be interpreted as reflecting an intention that the claimed examples require more features than are expressly recited in each claim. Rather, as the following claims reflect, inventive subject matter lies in less than all features of a single disclosed example. Thus the following claims are hereby incorporated into the Detailed Description, with each claim standing on its own as a separate example.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific examples. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific examples. However, the benefits, advantages, solutions to problems, and any feature(s) that may cause any benefit, advantage, or solution to occur or become more pronounced are not to be construed as a critical, required, or essential feature of any or all the claims. Moreover, the particular examples disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular examples disclosed above may be altered or modified and all such variations are considered within the scope of the disclosed subject matter. Accordingly, the protection sought herein is as set forth in the claims below.

INDUSTRIAL APPLICABILITY

The disclosed bit removal devices may be applicable to any cold planer, rotary mixer, or other machinery involving a rotary of bits which require removal. The disclosed bit removal devices may provide for improved serviceability, be used universally with different bit holders, allow for approach from the front of the bit holder, reduce noise pollution, and allow for better visibility for the technician.

Features of the disclosed bit removal devices (for example, at least the bracing element and the extraction element) allow for removal of the bit completely from the front side of the bit holder, instead of requiring the technician or the bit removal device to reach around the back side of the bit holder to push the bit out. This can allow for better visibility by the technician as during the bit removal process. Further, since the disclosed bit removal devices do not require that the bit holder have specific features to allow for removal of the bit, the disclosed bit removal devices may be used universally for a variety of different bit holders, making the disclosed bit removal devices more versatile than many conventional attempts.

Since the technician works in a constrained area within the rotor housing while removing the bits, the louder the bit removal device the more noise pollution the technician will be exposed to for the duration of the bit removal process. In some examples the disclosed bit removal devices may use an electric or hydraulic power source, which can reduce noise pollution (for example, relative to pneumatic devices).

What is claimed is:

1. A rotor bit removal device comprising:

a support configured to engage a bit holder of a paving machine rotor, wherein the support is configured to engage a neck portion of the bit holder from a front side of the bit holder;

an extractor coupled to the support, the extractor configured to engage a bit from the front side of the bit holder; and an actuator configured to move the extractor relative to the support to extract the bit from the bit holder.

2. The bit removal device of claim 1, wherein the extractor is configured to engage a washer or a collar of the bit.

3. The bit removal device of claim 1, wherein the extractor includes an arcuate bracket configured to engage the bit behind a collar or washer of the bit.

4. The bit removal device of claim 1, wherein the support includes an arcuate bracket for placement around the neck portion of the bit holder.

5. The bit removal device of claim 1, further comprising:

a user interface, wherein the actuator is configured to receive a signal from the user interface to control movement of the extractor.

6. The bit removal device of claim 5, wherein the user interface includes one or more triggers or buttons.

7. The bit removal device of claim 5, further comprising:

a handle, wherein at least a portion of the user interface is positioned on the handle.

8. The bit removal device of claim 1, wherein the actuator includes a hydraulic or electric power source.

9. The bit removal device of claim 1, further comprising:

a leadscrew including a longitudinal axis, wherein the actuator is configured to cause the leadscrew to rotate, moving the extractor relative to the support in an axial direction along the longitudinal axis.

10. The bit removal device of claim 1, wherein the extractor includes a pair of arms configured to be opened and closed.

11. The bit removal device of claim 10, wherein the support includes a pair of arms configured to be opened and closed.

12. The bit removal device of claim 10, wherein the support includes a sleeve that houses at least a portion of the extractor.

13. The bit removal device of claim 1, wherein the extractor includes a lever configured to tilt such that an end of the lever engages further behind the bit.

14. The bit removal device of claim 1, wherein the extractor includes a lever configured to engage the bit in a first position and to automatically move into a second position as the bit is removed.

15. The bit removal device of claim 14, wherein a greater portion of the lever is in contact with the bit in the second position than in the first position.

16. A rotor bit removal system comprising:

an extractor configured to engage a bit from a front side of a bit holder of a paving machine rotor to extract the bit from the bit holder;

a support coupled to the extractor and including a pair of arms configured to be opened and closed to engage the bit holder to support the extractor as it extracts the bit from the bit holder;

an actuator configured to move the extractor relative to the support such that the support remains engaged with the bit holder while the extractor removes the bit from the bit holder.

17. The bit removal system of claim 16, further comprising:

a connector configured to connect the actuator to a power source.

18. The bit removal system of claim 16, wherein the actuator is a hydraulic actuator or an electric actuator.

19. A method of manufacturing a rotor bit removal device, the method comprising:

providing a support configured to engage a bit holder of a paving machine rotor, wherein the support is configured to engage a neck portion of the bit holder from a front side of the bit holder;

providing an extractor configured to engage a bit from the front side of the bit holder; and coupling the support to the extractor with an actuator configured to move the extractor relative to the support to extract the bit from the bit holder.

20. The method of claim 19, further comprising:

providing the actuator with a hydraulic or electric power source.

* * * * *